US010457042B2

(12) United States Patent
Nakatani et al.

(10) Patent No.: US 10,457,042 B2
(45) Date of Patent: Oct. 29, 2019

(54) INKJET HEAD AND INKJET DEVICE USING SAME

(71) Applicant: Panasonic Intellectual Property Management Co., Ltd., Osaka (JP)

(72) Inventors: Shuhei Nakatani, Osaka (JP); Futoshi Ohtsuka, Kyoto (JP); Yousuke Toyofuku, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/118,186

(22) Filed: Aug. 30, 2018

(65) Prior Publication Data

US 2019/0077144 A1 Mar. 14, 2019

(30) Foreign Application Priority Data

Sep. 11, 2017 (JP) ..... 2017-173618
Jul. 10, 2018 (JP) ..... 2018-130333

(51) Int. Cl.

*B41J 2/045* (2006.01)
*B41J 2/145* (2006.01)
*B41J 2/14* (2006.01)

(52) U.S. Cl.

CPC ..... *B41J 2/04541* (2013.01); *B41J 2/04581* (2013.01); *B41J 2/145* (2013.01); *B41J 2/14274* (2013.01); *B41J 2202/12* (2013.01)

(58) Field of Classification Search

CPC ..... B41J 2/04541; B41J 2/14274; B41J 2/04581; B41J 2/145; B41J 2202/12

See application file for complete search history.

(56) References Cited

U.S. PATENT DOCUMENTS

2014/0267500 A1* 9/2014 Domae ..... B41J 2/14209 347/54

FOREIGN PATENT DOCUMENTS

JP 2012-011653 1/2012

OTHER PUBLICATIONS

IP.com search (Year: 2019).*

* cited by examiner

*Primary Examiner* — Lisa Solomon

(74) *Attorney, Agent, or Firm* — Greenblum & Bernstein, P.L.C.

(57) ABSTRACT

An object of the disclosure is to provide an inkjet head that makes it possible to realize alleviation of ink-discharge malfunction due to fluid crosstalk possibly caused among multiple discharge components, and that also simultaneously makes it possible to maintain a desirable volume of discharged liquid droplets. Furthermore, another object of the disclosure is to provide an inkjet device including the inkjet head.

13 Claims, 15 Drawing Sheets

INKJET HEAD AND INKJET DEVICE USING SAME

TECHNICAL FIELD

The technical field relates to inkjet heads, and inkjet devices using the same.

BACKGROUND

Drop-on-demand-type inkjet heads have been known as inkjet heads that make it possible to coat required amounts of inks when required, depending on input signals.

In particular, piezoelectric (piezoelectric-element-type) drop-on-demand-type inkjet heads include: ink-supply flow channels; multiple pressure chambers that are connected to the ink-supply flow channels and that have nozzles; and piezoelectric elements that apply pressures to inks filled within the pressure chambers.

FIGS. 1A and 1B show cross-sections of a general inkjet head.

The inkjet head includes: multiple nozzles 100 that discharge liquid droplets; pressure chambers 110 that communicate with the nozzles; partitions 111 that separate the pressure chambers each corresponding to the different nozzles; diaphragms 112 that form parts of the pressure chambers; piezoelectric elements 130 that cause the diaphragms 112 to oscillate; piezoelectric members 140 that support the partition 111; and common electrodes (not shown in figures) that apply voltages to the piezoelectric elements 130.

The inkjet head additionally includes a liquid inlet although such an inlet is not shown in the figures.

The piezoelectric elements 130, and the piezoelectric members 140 supporting the partitions 111 are separated from one piezoelectric member based on dicing.

With regard to the nozzles 100 possessed by the inkjet head, their diameter is from about 10 μm to about 50 μm, and about 100 to about 300 holes forming the nozzles are arranged at intervals of about 100 μm to about 500 μm.

The inkjet head configured in this manner is operated in the following way.

When a voltage is applied into an area between the common electrode (not shown in the figures) present at the backside of the piezoelectric element 130, the piezoelectric element 130 is caused to change from the state depicted in the FIG. 1A to the state depicted in the FIG. 1B.

When the rightmost piezoelectric element 130 in FIG. 1B deforms (a bottom part of the piezoelectric element 130 deforms), a volume of the pressure chamber 110 becomes smaller, and thus, a pressure is applied to the liquid.

Due to the resulting pressure, the ink present inside the pressure chamber 110 is discharged to the outside as a liquid droplet 150.

Furthermore, in a type of inkjet head that circulates an ink therein, the inkjet head is provided with a liquid inlet, and a liquid outlet, and thus, the ink is discharged while it is circulated therein.

Advantages obtained by circulation of the ink will be described below.

The ink present in the vicinity of the nozzle is constantly in contact with the atmosphere.

Since the contact area is very small, evaporation of a solvent in the ink is intolerable.

When the solvent in the ink is evaporated, a solid content concentration of the ink will be increased, and thus, a viscosity of the ink will be raised. This may impede normal discharge of the ink.

However, if the ink is circulated to the vicinity of the nozzle, the ink with increased viscosity can constantly be replaced with fresh ink. As a result, the discharged ink in the vicinity of the nozzle always has normal ink viscosity.

Accordingly, nozzle congestion can be suppressed, and thus, constant normal discharge of the ink can be realized.

The inkjet head may have a structure based on a film-type piezoelectric element.

FIGS. 2A and 2B are diagrams that show structures of such a film-type inkjet head.

In FIG. 2A, anozzle 200 discharging a liquid, apressure chamber 210 leading to the nozzle, and a common pressure chamber 230 supplying a liquid to the pressure chamber are communicated with each other.

A film-type piezoelectric element 220 is configured on a diaphragm 212 that forms a part of the pressure chamber.

The inkjet head configured in this manner is operated in the following way.

When a voltage is applied to the film-type piezoelectric element 220, a shape of the film-type piezoelectric element 220 is changed from a state depicted in FIG. 2A to a state depicted in FIG. 2B.

When the film-type piezoelectric element 220 is deformed, a volume of the pressure chamber 210 becomes smaller, and a pressure can be conveyed to the liquid.

Based on the pressure, the liquid droplet 150 is discharged from the nozzle.

In the inkjet head having such a flow channel structure, when one piezoelectric film is driven to discharge the ink from the nozzle, a flow of the ink caused in the process of discharge influences other nozzles that are communicated with the same flow channel through a common flow channel, and a phenomenon called "crosstalk" in which the ink discharge becomes unstable will be caused.

FIG. 3 shows a cross-section view of an inkjet head disclosed in JP-A-2012-11653.

In order to cope with the problem of crosstalk, JP-A-2012-11653 discloses the following structure in an inkjet head including multiple nozzles 500 that discharge liquid droplets, multiple pressure chambers 501 provided corresponding to the multiple nozzle 500, and multiple energy-generating elements 502 applying discharge forces to the liquids inside the pressure chambers. That is, in the inkjet head, common flow channels 503 supplying liquids to the multiple pressure chambers 501, and throttle parts 504 provided in parts of flow channels each connecting between the pressure chambers and the common flow channels 503 are provided.

When pressure waves caused in the pressure chambers 501 pass through the throttle part 504, the pressure waves decay, and thus, are hardly transmitted to pressure chambers 501 for the other nozzles, thereby alleviating crosstalk.

SUMMARY

However, in the inkjet head disclosed in JP-A-2012-11653, channel resistance of the throttle parts 504 will be greater than channel resistance of the nozzle 500, and, consequently, large amounts of pressures caused by oscillation of the energy-generating element 502 will be transmitted to the nozzle 500.

As a result, a volume of the liquid droplet discharged from the nozzle 500 will be excessively large, and thus, the volume of the liquid droplet may not be able to be maintained at a desirable level.

Also, in inkjet heads that make it possible to discharge a minute liquid droplet with a volume of 1 pL, a diameter of the nozzle 500 is about 10 μm, and it would be difficult to form smaller pores while maintaining sufficient machining accuracy.

Thus, an object of the disclosure is to provide an inkjet head that makes it possible to simultaneously realize alleviation of discharge malfunction due to fluid crosstalk caused among multiple nozzles, and maintenance of desirable discharge volumes of liquid droplets, and an inkjet device using the same.

In order to achieve the above object, according to one aspect of the disclosure, provided is an inkjet head, including: (i) multiple discharge units, each including a nozzle that discharge a liquid droplet, a first pressure chamber that is connected to the nozzle, a supply-side second pressure chamber and a discharge-side pressure chamber that are connected to the first pressure chamber, a supply-side third pressure chamber that is connected to the supply-side second pressure chamber, a discharge-side third pressure chamber that is connected to the discharge-side second pressure chamber, an energy-generating element that imparts a discharge force to a liquid inside the first pressure chamber, a supply-side first throttle part that is provided between the first pressure chamber and the supply-side second pressure chamber, a discharge-side first throttle part that is provided between the first pressure chamber and the discharge-side second pressure chamber, a supply-side second throttle part that is provided between the supply-side second pressure chamber and the supply-side third pressure chamber, and a discharge-side second throttle part that is provided between the discharge-side second pressure chamber and the discharge-side third pressure chamber; (ii) a supply-side common flow channel that connects the supply-side third pressure chambers in the respective multiple discharge units; and (iii) a discharge-side common flow channel that connects the discharge-side third pressure chambers in the respective multiple discharge units.

Moreover, according to another aspect of the disclosure, provided is an inkjet head, including: (i) multiple discharge units, each including a nozzle that discharges a liquid droplet, a first pressure chamber that is connected to the nozzle, a supply-side second pressure chamber and a discharge-side pressure chamber that are connected to the first pressure chamber, a supply-side third pressure chamber that is connected to the supply-side second pressure chamber, an energy-generating element that imparts a discharge force to a liquid inside the first pressure chamber, a supply-side first throttle part that is provided between the first pressure chamber and the supply-side second pressure chamber, a discharge-side first throttle part that is provided between the first pressure chamber and the discharge-side second pressure chamber, and a supply-side second throttle part that is provided between the supply-side second pressure chamber and the supply-side third pressure chamber; (ii) a supply-side common flow channel that connects the supply-side third pressure chambers in the respective multiple discharge units; and (iii) a discharge-side common flow channel that connects the discharge-side second pressure chambers in the respective multiple discharge units.

Furthermore, according to yet another aspect of the disclosure, provided is an inkjet device, including: the inkjet head; a drive control unit that produces a drive voltage signal applied to the energy-generating element and that controls a discharge action of the inkjet head; and a conveying unit that causes a relative movement of the inkjet head and a subject to be lithographed.

According to the inkjet head and the inkjet device of the disclosure, it becomes possible to alleviate fluid crosstalk that may be caused mutually among multiple nozzles. Furthermore, it becomes possible to maintain desirable minute volumes of liquid droplets, thereby realizing high-accuracy discharge of liquid droplets. As a result, high printing quality can be realized.

DESCRIPTION OF EMBODIMENTS

Hereinafter, embodiments of the disclosure will be described with reference to the drawings.

First Embodiment

<Structure of an Inkjet Head>

Figure 1A:
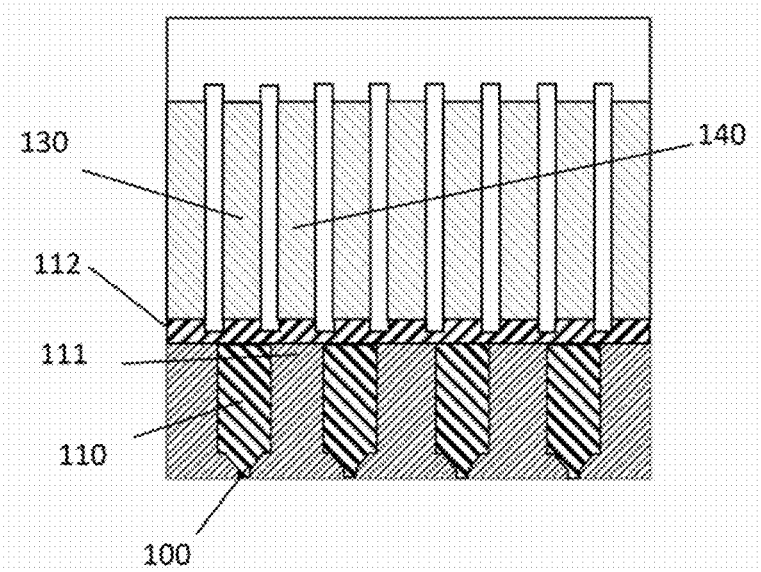
FIG. 1A PRIOR ART
FIG. 1A is a diagram that shows a structure of a conventional bulk-type inkjet head.
Figure 1B:
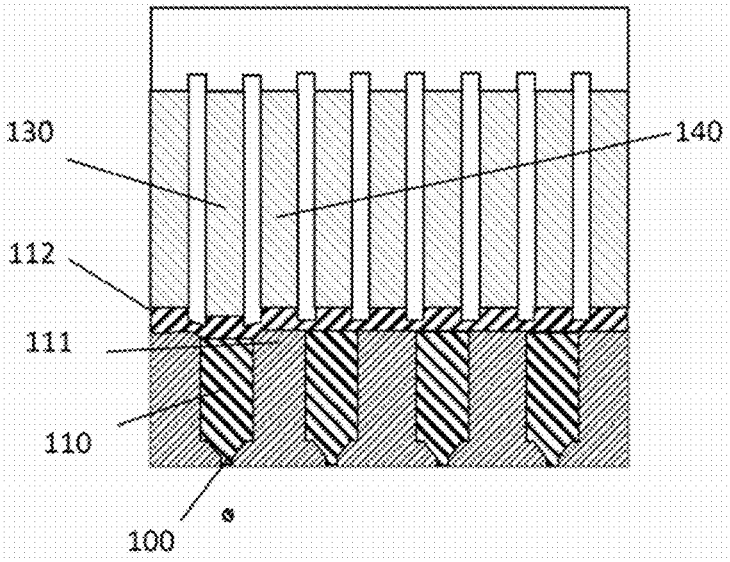
FIG. 1B PRIOR ART
FIG. 1B is a diagram that shows a state of the bulk-type inkjet head shown in FIG. 1A when a voltage is applied to a piezoelectric element.
Figure 2A:
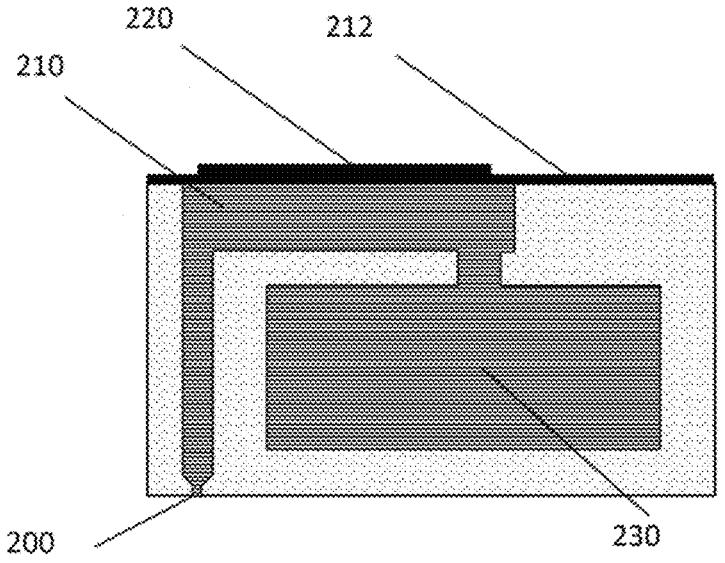
FIG. 2A PRIOR ART
FIG. 2A is a diagram that shows a structure of a conventional film-type.
Figure 2B:
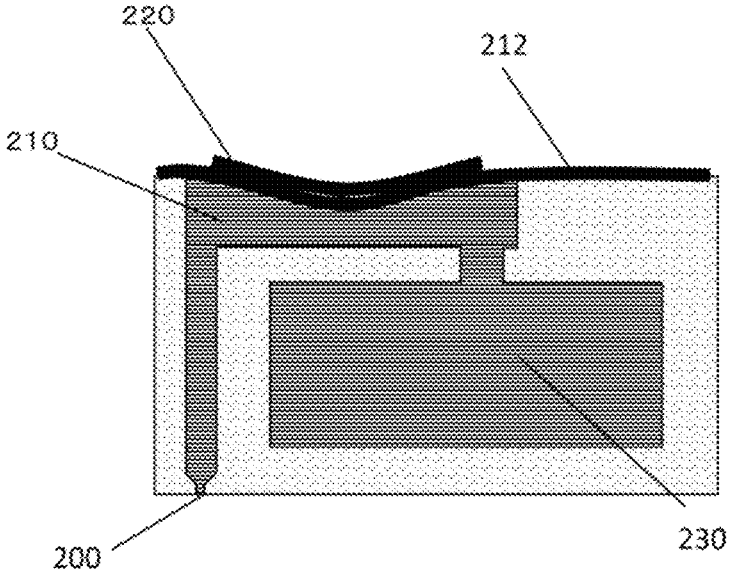
FIG. 2B PRIOR ART
FIG. 2B is a diagram that shows a state of the film-type inkjet head shown in FIG. 2A when a voltage is applied to a piezoelectric element.
Figure 3:
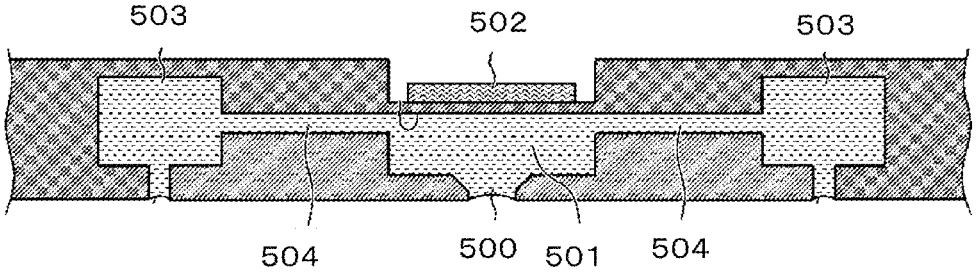
FIG. 3 PRIOR ART
FIG. 3 is a cross-section view of the inkjet head disclosed in JP-A-2012-11653.
Figure 4A:
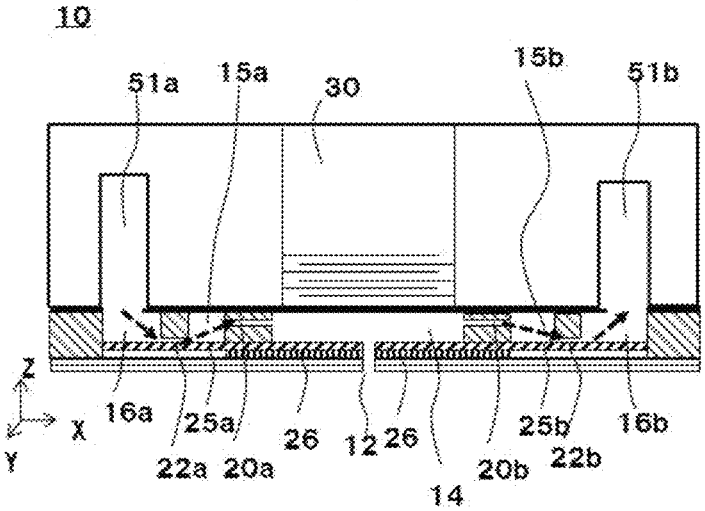
FIG. 4A is a cross-section view that schematically illustrate an inkjet head according to an embodiment.

FIG. 4A is a cross-section view that schematically illustrates a structure of the inkjet head according to the first embodiment.

Figure 4B:
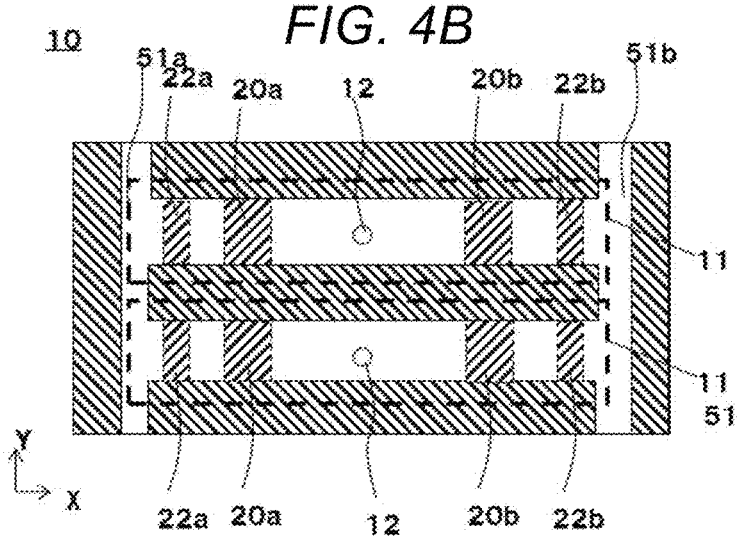
FIG. 4B is an X-Y cross-section view of the inkjet head in FIG. 4A.

FIG. 4B is X-Y cross-section view of the inkjet head in FIG. 4A.

Figure 4C:
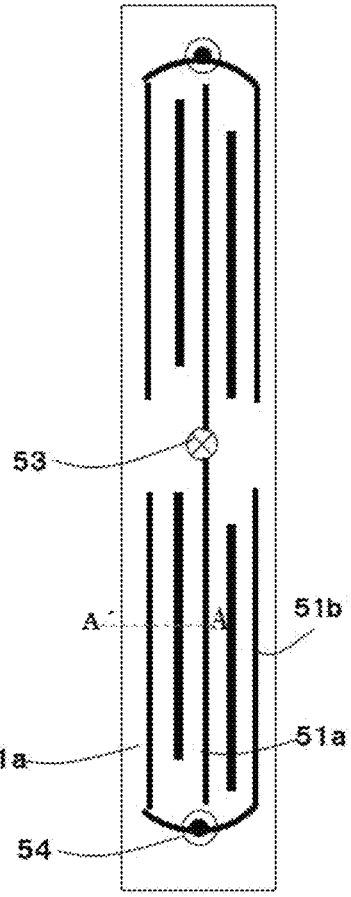
FIG. 4C is a plan view of an entire body of an inkjet head according to a first embodiment.

FIG. 4C is a plan view of the entire body of the inkjet head.

In this embodiment, the inkjet head 10 discharging ink droplets will be described as one example. However, liquids discharged in the disclosure are not limited to inks.

The inkjet head 10 includes a nozzle 12 that serves as an ink discharge outlet, and a first pressure chamber 14 that is communicated with the nozzle 12.

The first pressure chamber 14 possesses an actuator 30, namely an energy-generating element.

As a supply-side flow channel that supplies an ink to the first pressure chamber 14, there are the following components.

A supply-side second pressure chamber 15*a* that is communicated with the first pressure chamber 14 via a supply-side first throttle part 20*a* causing a liquid to flow into and out of the first pressure chamber 14 is provided.

Furthermore, a supply-side third pressure chamber 16*a* that is communicated with the supply-side second pressure chamber 15*a* via a supply-side second throttle part 22*a* is provided.

As a discharge-side flow channel that discharges from the first pressure chamber 14, there are the following components.

A discharge-side second pressure chamber 15*b* that is communicated with the first pressure chamber 14 via a discharge-side first throttle part 20*b* causing a liquid to flow into and out of the first pressure chamber 14 is provided.

Furthermore, a discharge-side third pressure chamber 16*b* that is communicated with the discharge-side second pressure chamber 15*b* via a discharge-side second throttle part 22*b* is provided.

The supply-side flow channel and the discharge-side flow channel are preferably provided so as to face one another centering the first pressure chamber 14

Furthermore, the first pressure chamber 14, the supply flow channel, and the discharge-side flow channel are preferably linearly arranged, and are preferably arranged in parallel in a bottom part of the inkjet head 10.

A combination of the first pressure chamber 14, and the discharge-side and supply-side flow channels for the ink serves as one discharge unit 11.

In the inkjet head 10, multiple discharge units 11 are arranged in parallel.

Moreover, a supply-side common flow channel 51*a* that connects supply-side third pressure chambers 16*a* with each other in the multiple discharge units 11 is provided.

Furthermore, discharge-side common flow channel 51*b* that connect discharge-side third pressure chambers 16*b* with each other in the multiple discharge units 11 is provided.

The nozzle 12 is a through-hole that discharges the ink, and the diameter thereof is from about 5 μm to about 30 μm.

As examples working techniques for forming such a through-hole, techniques based on laser beam machining, etching, or punching can be mentioned.

The first pressure chamber 14 has a role in accumulating pressures produced by oscillation of the actuator 30.

Degree of pressures accumulated therein will vary with a volume of the first pressure chamber 14, and channel resistance of the supply-side first throttle part 20*a* and the discharge-side first throttle part 20*b*.

Therefore, the volume of the first pressure chamber 14 or the like may need to be optimized according to a desirable volume or speed of the liquid droplet to be discharged from the nozzle.

The supply-side second pressure chamber 15*a*, the discharge-side second pressure chamber 15*b*, the supply-side third pressure chamber 16*a*, the discharge-side third pressure chamber 16*b*, the supply-side common flow channel 51*a*, and a discharge-side supply path 51*b* serve as a path of the ink.

The pressure chambers and flow channels may be formed through thermal-diffusion junction of metal plates that have been processed, for example, by etching, etching of silicon materials, etc.

<Supply-Side Damper 25*a* and Discharge-Side Damper 25*b*>

Features described below may be provided in at least either of the supply flow channel and the discharge-side flow channel. However, the features are preferably provided in both of them.

Furthermore, at least one of walls forming the supply-side second throttle part 22*a*, the discharge-side second throttle part 22*b*, the supply-side second pressure chamber 15*a* and the discharge-side second pressure chamber 15*b*, may be formed of plates with high elasticity.

The plates serve as a supply-side damper 25*a* and a discharge-side damper 25*b* that are present within the supply-side second pressure chamber 15*a* and the discharge-side second pressure chamber 15*b*, respectively.

The supply-side damper 25*a* and the discharge-side damper 25*b* may be thin metal plates or resin films. However, materials therefor are not limited.

The supply-side damper 25*a* and the discharge-side damper 25*b* may be provided perpendicular to the Z-axis direction.

The supply-side damper 25*a* and the discharge-side damper 25*b* provided within the first pressure chamber 14 are retained by rigid plates 26.

Accordingly, damping effects for oscillating waves will not be brought about, and oscillating waves required for discharge of the ink will not decay.

Additionally, although the supply-side damper 25*a* and the discharge-side damper 25*b* are not necessarily required in the first pressure chamber 14, they may be provided in order to form the supply-side common flow channel 51*a*, the discharge-side common flow channel 51*b*, etc. based on etching.

On the other hand, the supply-side damper 25*a* and the discharge-side damper 25*b* are not retained by the rigid plates 26 within regions of the supply-side second pressure chamber 15*a* and the supply-side third pressure chamber 16*a*, and the discharge-side second pressure chamber 15*b* and the discharge-side third pressure chamber 16*b*, respectively. The supply-side damper 25*a* and the discharge-side damper 25*b* are provided in midair within the regions, while only their edges are fixed.

Since the supply-side damper 25*a* and the discharge-side damper 25*b* are provided in midair as mentioned above, oscillating waves present in the supply-side second pressure chamber 15*a*, the discharge-side second pressure chamber 15*b*, the supply-side third pressure chamber 16*a*, and the discharge-side third pressure chamber 16*b* are caused to decay due to damping effects, and fluid crosstalk possibly caused mutual interactions between adjacent nozzles 12 will be alleviated.

<Locations of the Supply-Side First Throttle Part 20*a*, the Discharge-Side First Throttle Part 20*b*, the Supply-Side Second Throttle Part 22*a*, and the Discharge-Side Second Throttle Part 22*b* in the z-Axis Direction>

Since locations of the supply-side first throttle part 20*a* and the discharge-side first throttle part 20*b*, and the supply-side second throttle part 22*a* and the discharge-side second throttle part 22*b* in the z-axis direction differs from each other, oscillating waves caused by oscillation of the actuator 30 pass through the supply-side first throttle part 20*a* and the discharge-side first throttle part 20*b*, and reach the supply-side second pressure chamber 15*a*, and the discharge-side second pressure chamber 15*b*, respectively. Then, the oscillating waves pass through the supply-side second throttle part 22*a* and the discharge-side second throttle part 22*b*, respectively.

As a result, with moving directions of the oscillating waves, many components that intersect with surfaces of the supply-side damper 25*a* and the discharge-side damper 25*b* will be present.

Additionally, in a case in which the locations in the z-axis direction differs from each other, this means that a line joining the supply-side first throttle part 20*a* and the supply-side second throttle part 22*a*, and a line joining the discharge-side first throttle part 20*b* and the discharge-side second throttle part 22*b* (dot-line arrows in FIG. 4A) is not parallel to a plane perpendicular to a discharging direction of the liquid droplet from the nozzle 12 (i.e., a surface of the damper 25 in FIG. 4A).

Or more specifically, this means that each of them is not parallel to the ink flowing direction.

In addition, the ink discharging direction is parallel to the z-axis direction.

In FIG. 4A, the ink discharging direction is perpendicular to the bottom surface where the nozzle 12 is present.

In this case, the supply-side first throttle part 20*a* is farther away from the supply-side damper 25*a* then the supply-side second throttle part 22*a*.

Relations between moving directions of the oscillating waves, and a direction parallel to surfaces of the supply-side damper 25*a* and the discharge-side damper 25*b* were studied based on fluid analyses.

As a result, it was revealed that effects of decay of oscillating waves were greater in a direction in which the moving directions of oscillating waves run straight to the surfaces of the supply-side damper 25*a* and the discharge-side damper 25*b*.

Therefore, according to structures of present embodiments, damping effects will be more significant.

The supply-side damper 25*a* and the discharge-side damper 25*b* are provided so as to bring about the most remarkable damping effects against the flow of ink in the discharge direction.

<Channel Resistance of the Supply-Side Second Throttle Part 22*a* and the Supply-Side First Throttle Part 20*a*>

Channel resistance of the supply-side second throttle part 22*a* is greater than channel resistance of the supply-side first throttle part 20*a*.

The presence of the supply-side second throttle part 22*a* prevents the influences on other discharge units 11.

In the same manner, channel resistance of the discharge-side second throttle part 22*b* is greater than channel resistance of the discharge-side first throttle part 20*b*.

<Overall Structure>

Although FIG. 4A shows only one discharge unit 11, i.e., only the vicinity of one nozzle 12, multiple discharge units 11 are provided in the inkjet head 10.

For example, in FIG. 4A, multiple discharge units 11 may be arrayed in the Y-axis direction.

The multiple discharge units 11 may be connected to the supply-side common flow channel 51*a* and the discharge-side common flow channel 51*b*, in parallel, although such a structure is not explicitly shown in FIG. 4C.

Additionally, the supply-side common flow channel 51*a* and the discharge-side common flow channel 51*b* are connected to an ink reservoir that is not shown in the figures, and the ink reservoir is further connected to an ink tank (not shown in the figures) that serves as an ink supply source.

Through the ink reservoir and an ink inlet 53, the ink is supplied into the supply-side common flow channel 51*a*, and the ink that has been flown into the multiple discharge-side common flow channels 51*b* arrayed in the Y-axis direction is discharged from an ink outlet 54.

The ink reservoir is a second ink tank that is present between the supply-side common flow channel 51*a* and the discharge-side common flow channel 51*b*.

Based on pressurization or depressurization against the second ink tank, pressures applied to the nozzle 12 are controlled, and thus, the ink is discharged in an appropriate state.

Cross-section areas of the supply-side first throttle part 20*a*, the discharge-side first throttle part 20*b*, the supply-side second throttle part 22*a*, and the discharge-side second throttle part 22*b* are sufficiently smaller, compared with those of the first pressure chamber 14, the supply-side second pressure chamber 15*a*, the discharge-side second pressure chamber 15*b*, the supply-side third pressure chamber 16*a*, and the discharge-side third pressure chamber 16*b*, and therefore, they function as throttle parts.

Pressure differences are caused between the ink-supplying tank connected to the supply-side third pressure chamber 16*a*, and an ink-collecting tank connected to the discharge-side third pressure chamber 16*b*, and thus, the ink is constantly moved.

By way of adopting such an ink circulation system, fresh inks can constantly be supplied to the first pressure chambers 14, and thus, an increase in the viscosity of the ink in the vicinity of the nozzle 12, which is in contact with the atmosphere can be prevented.

Accordingly, it becomes possible to realize long-term stable ink discharge.

<Actuator 30>

As actuators 30 in this embodiment, piezoelectric elements are used.

The piezoelectric elements have a structure in which a piezoelectric body is provided between a lower electrode and upper electrodes, and multiple layers are stacked.

The lower electrode serves as a common electrode for multiple actuators 30, and upper electrodes are provided as separate electrodes corresponding to the respective actuators 30.

When a drive voltage is applied between the electrodes in the actuators 30, the actuators 30 are displaced, and thus, volumes of the first pressure chambers 14 will be changed.

The changes in the volumes cause discharge of the inks from the nozzles 12.

In addition, although d33 mode piezoelectric actuators 30 are described as examples in this embodiment, energy-generating elements employed as actuators 33 are not limited to such piezoelectric actuators, and various types of actuators such as d31 mode or shear mode piezoelectric actuators, electrostatic actuators, and heater elements can be employed.

Energy-generating elements that are compatible with types of adopted discharge systems may be employed.

Additionally, the flow channel structure as shown in FIG. 4A can be formed by way of etching silicon (Si) materials to form groves and pores serving as flow channel parts, thermal diffusion junction of etched metal plates, and the like.

Evaluations of Examples and Comparative Examples

Influences of fluid crosstalk caused by mutual interactions between multiple discharge components on discharge properties were evaluated with respect to examples and comparative examples below.

An evaluation method is as follows.

In cases in which inks are discharged from all of nozzles 12 provided in the inkjet head 10, while the timing of applying drive waves to the actuator 30 was shifted by an interval of 1 microsecond in each time only for one nozzle, and the discharge speed of the liquid droplet from the nozzle 12 to which the timing of applying the drive waves was shifted was evaluated.

While stroboscopically illuminating the liquid droplets in synchronization with the timing of applying drive waves, the liquid droplets were observed with a camera.

Furthermore, by delaying the timing of stroboscopic luminescence, liquid droplets at two points were observed, and thus, discharge speeds of liquid droplets were evaluated.

Inks used for the evaluations had a viscosity of 8 mPa·s, and a surface tension of 33 mN/m.

The viscosity was measured with a viscometer "AR-G2" (TA Instruments).

The surface tension was measured with a surface tensiometer "DSA100" (KRUSS).

Conditions and evaluations results for examples and comparative examples are shown in Table 1.

Additionally, as acceptability criteria for variations in the speeds, a value of 2.5 m/s or smaller was adopted for inkjet heads 10 that discharge a volume of 4 pL, and a value of 6.1 m/s or smaller was adopted for inkjet heads 10 that discharge a volume 1 pL.

This is because such conditions are required for coating of display panels as mentioned in the section of discussion below.

Variations in speeds in Table 1 refer to largest values of differences between maximums and minimums.

Example 1

A structure of an inkjet head in Example 1 is the same as the structure of the head shown in FIG. 4A.

Figure 5:
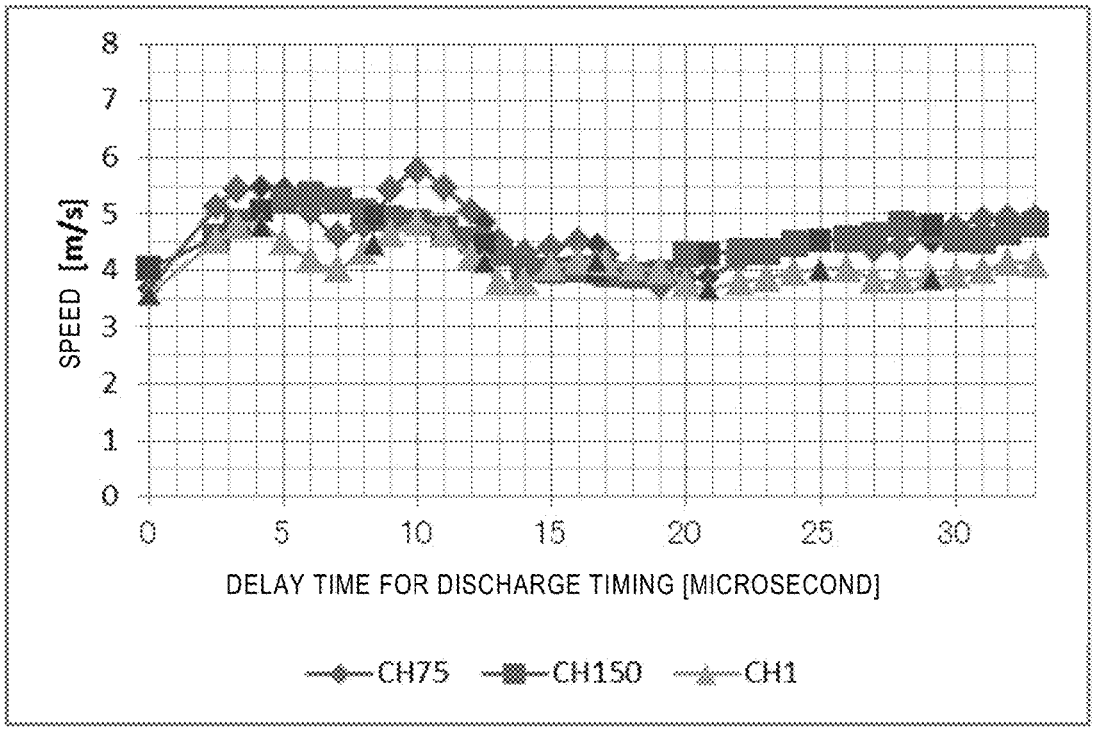
FIG. 5 is a diagram that shows variations in the speed of an inkjet head in Example 1.

Results of the evaluations on the inkjet head of Example 1 are shown in FIG. 5.

In FIG. 5, the horizontal axis refers to a delay time (microseconds) for the discharge timing of liquid droplets, and the vertical axis refers to a discharge speed of liquid droplets, and the results were obtained through evaluations on three nozzles in one inkjet head 10.

The delay time for the discharge timing refers to the delay time for the start of application of drive waves to the respective actuators 30.

CH75, CH150, and CH1 each refers to ID numbers of the nozzles 12.

In this example, data were obtained for representative three nozzles ($75^{th}$, $150^{th}$, and $1^{st}$) among 150 nozzles in one row of nozzles.

CH150 and CH1 refers to nozzles 12 at the both sides, and CH75 refers to a nozzle 12 located in the center.

The point where the delay time is 0 microsecond refers to discharge speeds when inks are discharged simultaneously from all of the nozzles 12.

Depending on locations of the nozzles 12 (i.e., depending differences of CH75, CH150 and CH1), degrees of influences of fluid crosstalk vary, and behaviors of the discharge speeds vary. However, it was revealed that, around time points when the delay times for the discharge timing were 4 microseconds and 10 microseconds, respectively, the discharge speeds of the liquid droplets were significantly varied.

It is considered that these delay times correspond to timings of discharge in which oscillating waves among multiple nozzles 12 resonate with each other.

In a domain where the delay time is equal to or greater than 15 microseconds, there are almost no significant variations in the discharge speed. Thus, it is considered that the oscillating waves are sufficiently decayed until the point of 15 microseconds.

A range of variations in the discharge speed to the delay time of discharge timing is expressed by values of (maximum of the speed)−(minimum of the speed), and the values obtained for the $75^{th}$ nozzle (CH75), the $150^{th}$ nozzle (CH150), and the first nozzle (CH1) are 2.1 m/s, 1.4 m/s, and 1.2 m/s, respectively, of the nozzles 12.

TABLE 1

Figure 6:
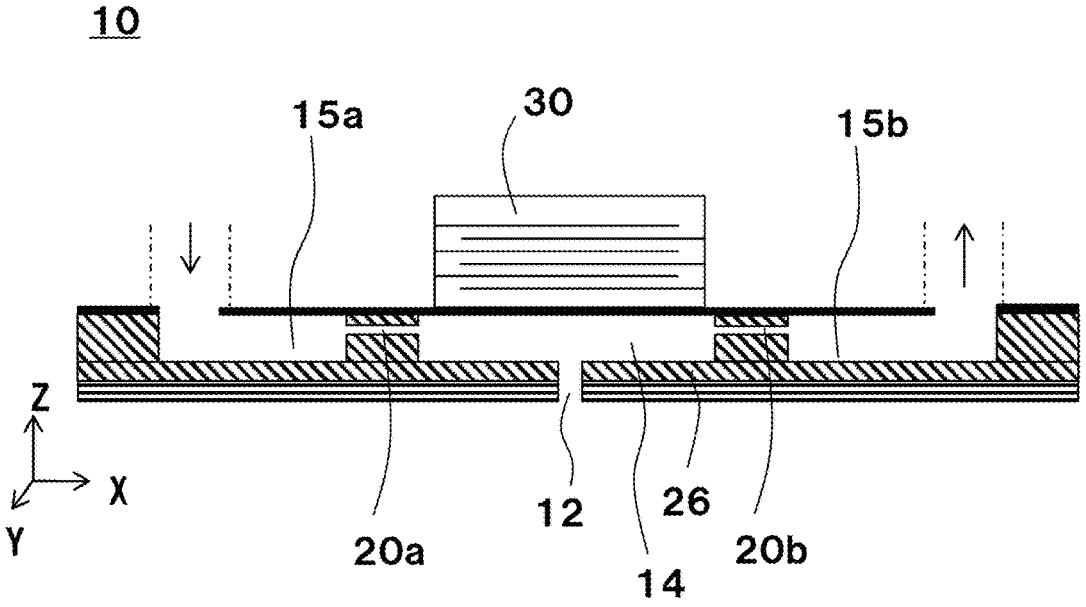
FIG. 6 is a cross-section view of an inkjet head in Comparative Example 1.
Figure 8:
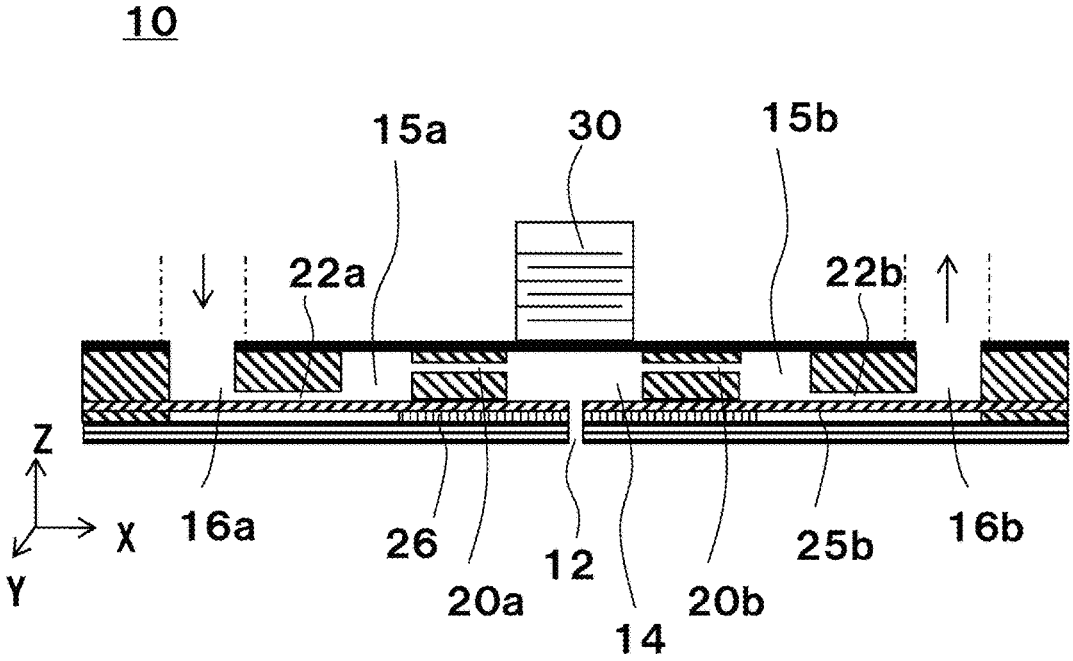
FIG. 8 is a cross-section of an inkjet head in Example 2.
Figure 10:
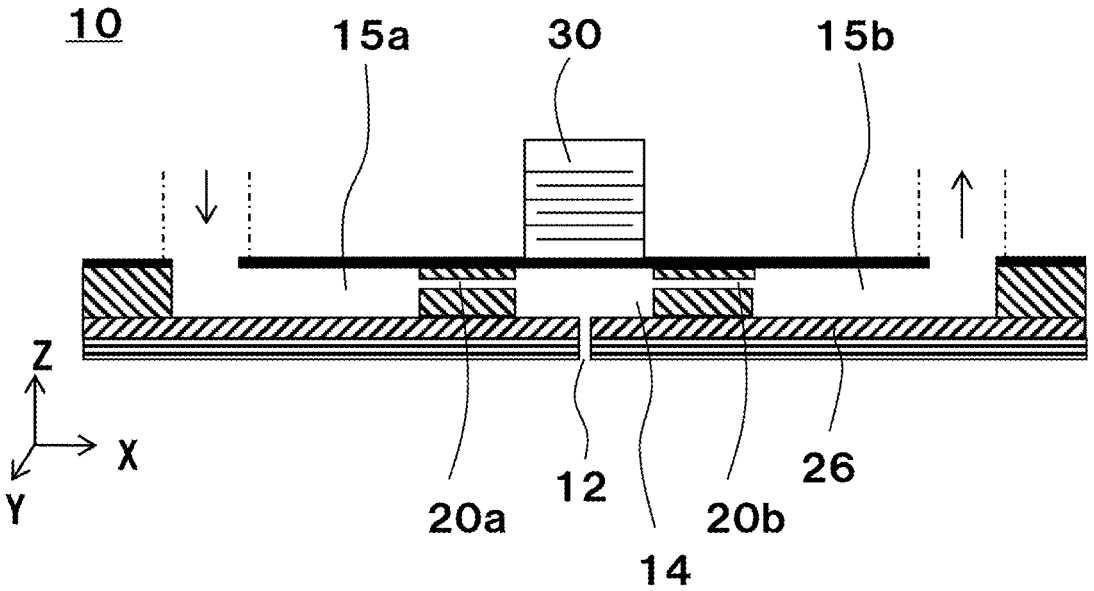
FIG. 10 is a cross-section of an inkjet head in Comparative Example 2.
Figure 12:
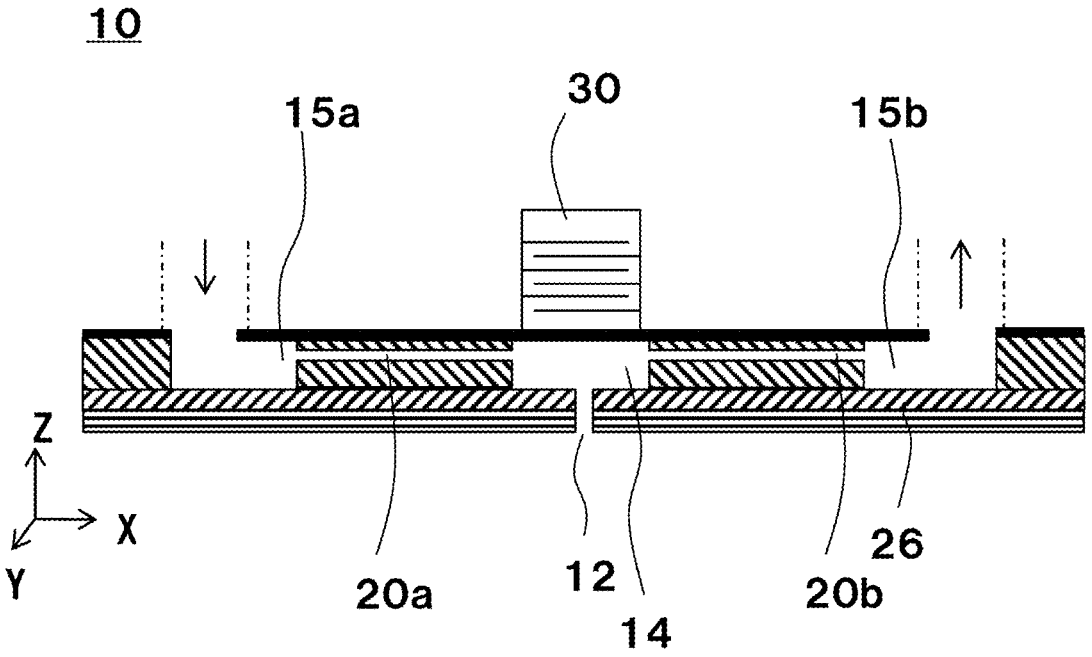
FIG. 12 is a cross-section of an inkjet head in Comparative Example 3.

| | Structure | Feature of Structure | Variations in Speed (m/s) | Volume of liquid droplet (pL) | Acceptance | (Maximum-Minimum) of speed associated with fluid crosstalk | | |
|---|---|---|---|---|---|---|---|---|
| | | | | | | $75^{th}$ nozzle 12 (m/s) | $150^{th}$ nozzle 12 (m/s) | 1st nozzle 12 (m/s) |
| Example 1 | FIG. 4 | First and second throttle parts | 2.1 | 4 | Yes | 2.1 | 1.4 | 1.2 |
| Example 2 | FIG. 8 | First and second throttle parts | 6.1 | 0.9 | Yes | 4.1 | 6.1 | 2.5 |
| Comparative Example 1 | FIG. 6 | Only first throttle part | 4.6 | 5 | No | 4.6 | 3.9 | 2.6 |
| Comparative Example 2 | FIG. 10 | Only first throttle part | 7.4 | 1 | No | 7.4 | 5.0 | 4.6 |
| Comparative Example 3 | FIG. 12 | Only first throttle part | 2.4 | 1.6 | No | 2.4 | 1.5 | 2.0 |

Comparative Example 1

FIG. 6 is a cross-section view of an inkjet head in Comparative Example 1.

Differences between the inkjet heads 10 of Comparative Example 1 and Example 1 will be described below.

The inkjet head 10 in Comparative Example 1 is not provided with any supply-side second throttle parts 22*a* and discharge-side second throttle parts 22*b*. Therefore, any supply-side third pressure chambers 16*a*, and any discharge-side third pressure chambers 16*b* are not provided in the inkjet head 10.

Furthermore, any supply-side dampers 25*a*, and any discharge-side dampers 25*b* are not also provided in the inkjet head 10.

A structure of the inkjet head in Comparative Example 1 is the same as the structure of the inkjet head in Example 1 except for the above-mentioned configuration.

Figure 7:
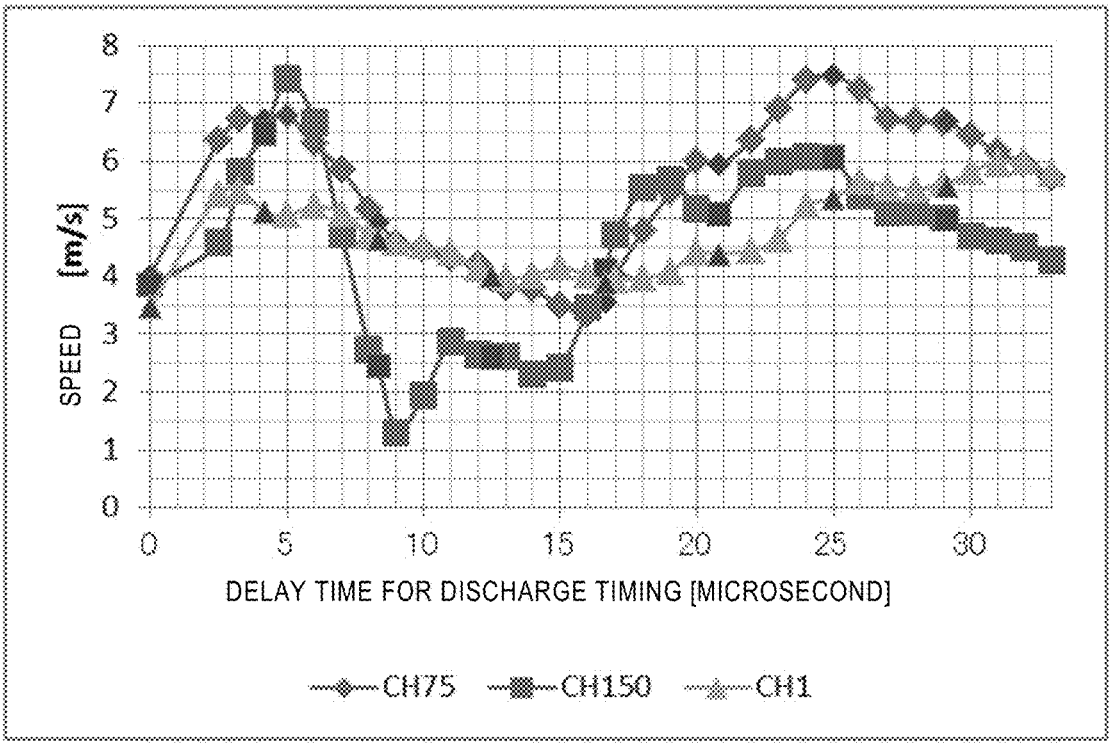
FIG. 7 is a diagram that shows variations in the speed of the inkjet head in Comparative Example 1.

FIG. 7 shows results of the evaluations on variations in the discharge speed for the inkjet head in Comparative Example 1 in a case where the timing of discharge was delayed in the same manner as Example 1.

It is realized that variations in the discharge speed in the inkjet head of Comparative Example 1 are more significant, compared with the values obtained in Example 1, since any supply-side second throttle parts 22*a* and any discharge-side second throttle parts 22*b*, and any supply-side dampers 25*a* and any discharge-side dampers 25*b* were provided in the inkjet head in Comparative Example 1.

Example 2

FIG. 8 is a cross-section view of an inkjet head in Example 2.

It would be understood that a volume of the first pressure chamber 14 is smaller, compared with the structure of the inkjet head in Example 1.

Although a volume of the first pressure chamber 14 would vary with a volume of a liquid droplet discharged from the nozzle, the volume of the first pressure chamber 14 is about 0.007 $mm^3$ in cases where a liquid droplet with a volume of about 1 pL is discharged from the nozzle.

Furthermore, the volume of the first pressure chamber 14 is about 0.025 $mm^3$ in cases where a liquid droplet with a volume of about 4 pL is discharged from the nozzle.

Based on the Hagen-Poiseuille equation, relations between the volume of the liquid droplet and resonance frequencies resulting from the internal structure of the inkjet head 10 can be represented by Formula 1, supposing that the inks flow as laminar flows inside fine flow channels in the inkjet head 10.

$$V=(S\times v)/(2\times f) \quad \text{(Formula 1)}$$

V: liquid droplet volume

S: nozzle cross-section area v: liquid droplet-discharging speed f: resonance frequency Thus, it is understood that, in order to cause a minute volume of a liquid droplet to be discharged from the nozzle, the volume of the first pressure chamber 14 needs to be smaller so as to increase resonance frequencies of the oscillating waves inside the first pressure chamber 14.

Since inverses of the resonance frequencies correspond to resonance periods, the resonance periods need to be smaller.

If the volume of the pressure chamber becomes smaller, then, the resonance frequencies becomes smaller. Therefore, it would be considered that reductions in the volume of the pressure chamber is a theoretically reasonable countermeasure to reduce the volume of the liquid droplet.

That is, the inkjet head 10 of Example 2 shown in FIG. 8 makes it possible to discharge a minute volume of the liquid droplet.

Furthermore, lengths of the supply-side second throttle part 22*a* and the discharge-side second throttle part 22*b* are larger than lengths of the supply-side first throttle part 20*a* and the discharge-side first throttle part 20*b*, respectively, in X-axis direction. Therefore, channel resistance of the supply-side second throttle part 22*a* and the discharge-side second throttle part 22*b* are larger than channel resistance of the supply-side first throttle part 20*a* and the discharge-side first throttle part 20*b*.

Additionally, lengths of the supply-side second throttle part 22*a* and the discharge-side second throttle part 22*b* are the same as lengths of the supply-side first throttle part 20*a* and the discharge-side first throttle part 20*b*, respectively, in Y-axis direction.

The supply-side first throttle part 20*a* and the discharge-side first throttle part 20*b* are associated with volumes of discharged liquid droplets. That is, when throttle lengths of the supply-side first throttle part 20*a* and the discharge-side first throttle part 20*b* are increased so as to raise the resistance, volumes of the liquid droplets discharged from the nozzles 12 will be larger.

Therefore, the resistance should not carelessly be raised in that way.

That is, in order to suppress crosstalk, the lengths of the supply-side first throttle part 20*a* and the discharge-side first throttle part 20*b* should be determined depending on volumes of liquid droplets, and the crosstalk can be suppressed by the lengths of the supply-side second throttle part 22*a* and the discharge-side second throttle part 22*b*.

In other words, lengths of the supply-side second throttle part 22*a* and the discharge-side second throttle part 22*b* are preferably larger than lengths of the supply-side first throttle part 20*a* and the discharge-side first throttle part 20*b*, respectively, in X-axis direction.

Figure 9:
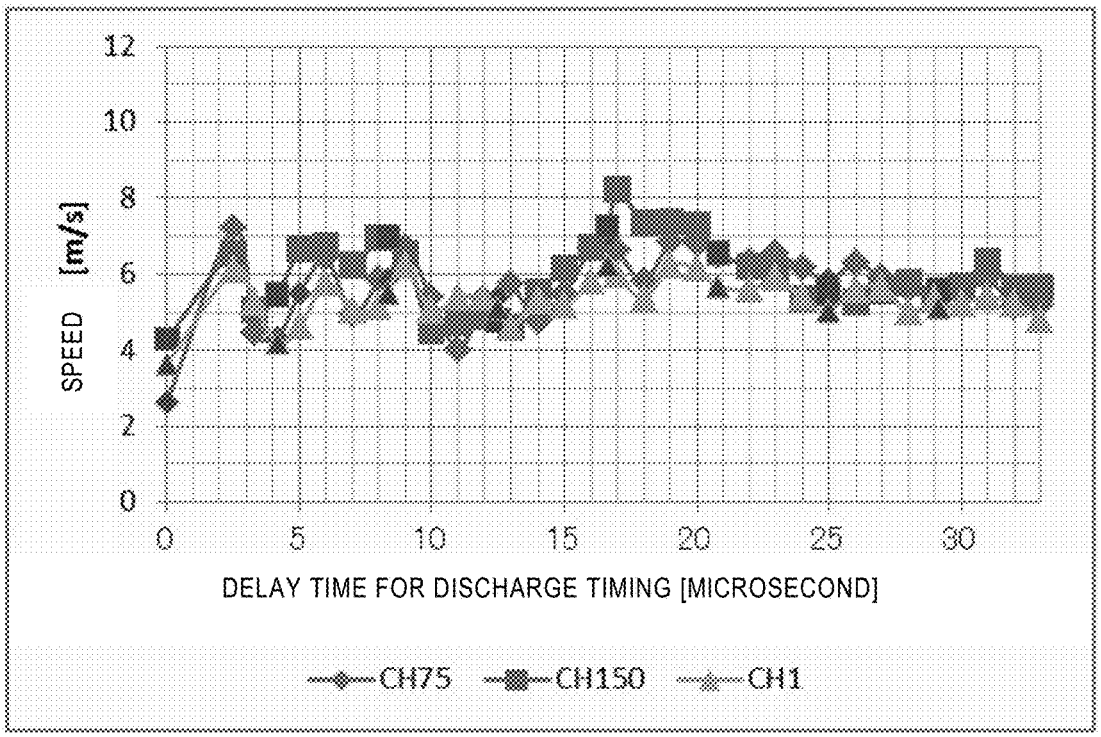
FIG. 9 is a diagram that shows variations in the speed of the inkjet head in Example 2.

FIG. 9 shows results obtained by measuring variations in the discharge speed when the timing of discharge was gradually delayed in the same manner as Example 1.

When ranges of variations in the discharge speed with respect to delay times of the discharge timing is expressed as values of differences between (maximum values of the speed) and (minimum values of the speed), values of the ranges of variations for the $75^{th}$ nozzle (CH75), the $150^{th}$ nozzle (CH150), and the first nozzle (CH1) of the nozzles 12 are 4.6 m/s, 3.9 m/s, and 2.6 m/s, respectively.

Additionally, a volume of the liquid droplet is 0.9 pL when the discharge speed is 5 m/s.

Comparative Example 2

FIG. 10 is a cross-section view of the inkjet head in Comparative Example 2.

Differences between structures of the inkjet heads of Comparative Example 2 and Example 2 will be described below.

The inkjet head in Comparative Example 2 is not provided with any supply-side second throttle parts 22*a* and discharge-side second throttle parts 22*b*. Therefore, any supply-side third pressure chambers 16*a*, and any discharge-side third pressure chambers 16*b* are not provided in the inkjet head of Comparative Example 2.

Furthermore, any dampers 25 are not also provided in the inkjet head of Comparative Example 2.

A structure of the inkjet head in Comparative Example 2 is the same as the structure of the inkjet head in Example 2 except for the above-mentioned configuration.

Figure 11:
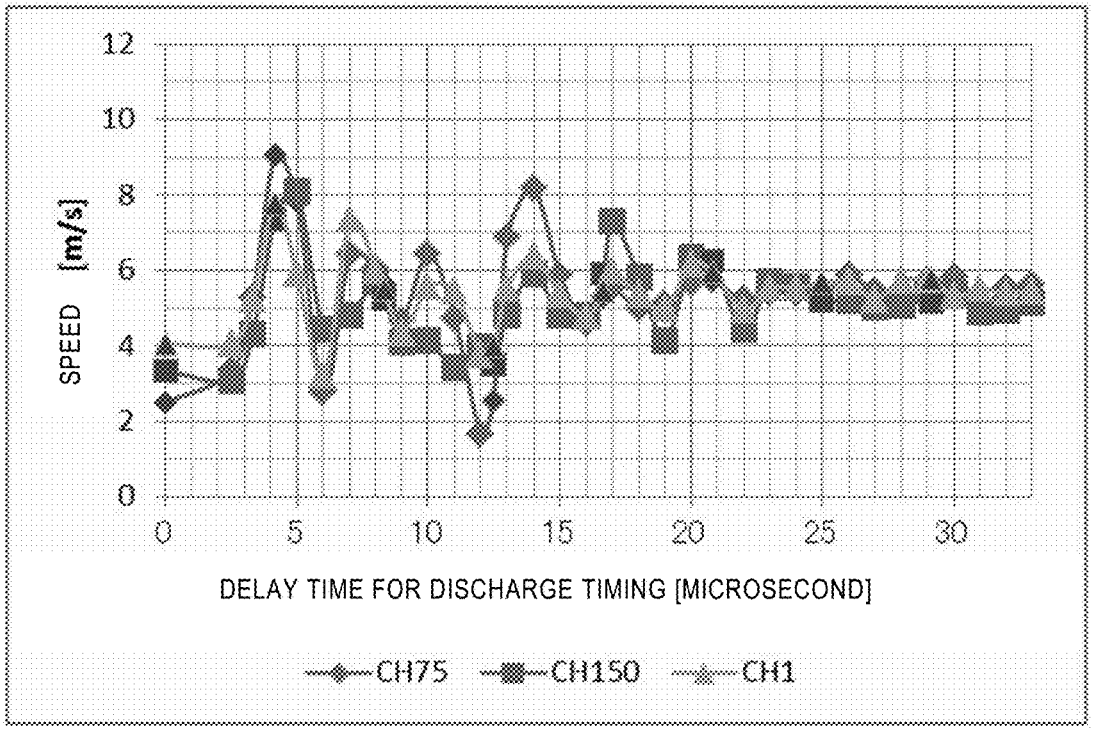
FIG. 11 is a diagram that shows variations in the speed of the inkjet head in Comparative Example 2.

FIG. 11 shows results obtained by evaluating variations in the discharge speed when the timing of discharge was gradually delayed in the same manner as Example 2.

Values of the ranges of variations to delay times of the discharge timing for the 75$^{th}$ nozzle (CH75), the 150$^{th}$ nozzle (CH150), and the first nozzle (CH1) of the nozzles 12 are 7.4 m/s, 5.0 m/s, and 4.6 m/s, respectively.

Additionally, a volume of the liquid droplet is 1.0 pL when the discharge speed is 5 m/s.

Although the volume of the liquid droplet is as small as 1.0 pL in the inkjet head according to Comparative Example 2, it is observed that fluid crosstalk among multiple discharge components, and the variations in the discharge speed are significant.

Comparative Example 3

FIG. 12 is a cross-section view of the inkjet head in Comparative Example 3.

Differences between structures of the inkjet heads of Comparative Example 3 and Example 2 will be described below.

The inkjet head in Comparative Example 3 is not provided with any supply-side second throttle parts 22*a* and discharge-side second throttle parts 22*b*. Therefore, any supply-side third pressure chambers 16*a*, and any discharge-side third pressure chambers 16*b* are not provided in the inkjet head of Comparative Example 3.

Furthermore, any dampers 25 are not also provided in the inkjet head of Comparative Example 2.

Lengths of the supply-side first throttle part 20*a* and the discharge-side first throttle part 20*b* are very large, and thus, a structure exhibiting very large channel resistance is formed in Comparative Example 3.

A structure of the inkjet head in Comparative Example 3 is the same as the structure of the inkjet head in Example 2 except for the above-mentioned configuration.

Figure 13:
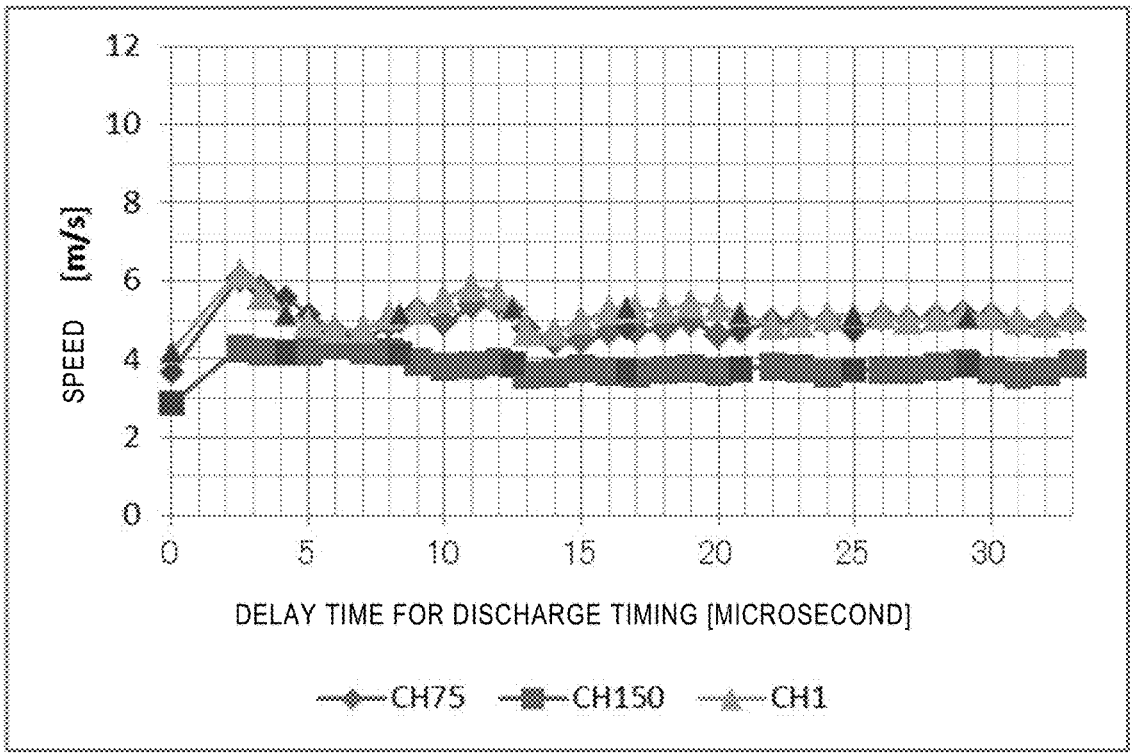
FIG. 13 is a diagram that shows variations in the speed of the inkjet head in Comparative Example 3.

FIG. 13 shows results obtained by evaluating variations in the discharge speed when the timing of discharge was gradually delayed in the same manner as Example 2.

Values of the ranges of variations to delay times of the discharge timing for the 75$^{th}$ nozzle (CH75), the 150$^{th}$ nozzle (CH150), and the first nozzle (CH1) of the nozzles 12 are 2.4 m/s, 1.5 m/s, and 2.0 m/s, respectively.

Additionally, a volume of the liquid droplet is 1.6 pL when the discharge speed is 5 m/s.

Although fluid crosstalk among multiple components is smaller in the inkjet head in Comparative Example 3, it is observed that the volume of the liquid droplet is as large as 1.6 pL.

Since lengths of the supply-side first throttle part 20*a* and the discharge-side first throttle part 20*b* are larger, and thus, the channel resistance is larger. Therefore, decay of the oscillating waves inside the flow channels is effectively caused.

However, since the channel resistance is very large, most of oscillating waves caused by oscillation of the actuator 30 are released from the nozzles 12.

As a result, the volume of the liquid droplet becomes larger although variations in the discharge speed due to the crosstalk are small.

A diameter of the nozzle in the inkjet head in Comparative Example 3 is 10 μm. It is difficult to form a pore with a diameter smaller than such a value while maintaining sufficient working accuracy.

The volume of the liquid droplet is determined by resolution of an image formed through inkjet coating. Therefore, if the volume of the liquid droplet is excessively larger than a threshold, it becomes difficult to coat inks while maintaining predetermined spotting accuracy.

DISCUSSION

For example, materials coated by the inkjet head in Example 2 are inks for forming red, green and blue luminescent layers in organic EL display panels.

Data including drive waves, derive voltages, and image patterns formed through coating are conveyed from a drive control mechanism to the inkjet head.

The inkjet head discharges inks into picture elements in an organic EL display panel that is a coating subject and that is placed on an operation stage, responding to the signals.

In cases where high-resolution organic displays are produced, it is required that a volume of the liquid droplet discharged by inkjet head is equal to or smaller than about 1 pL.

If the volume of the liquid droplet becomes larger, then, the diameter of the liquid droplet becomes larger, and thus, a margin for a location where the liquid droplet is spotted may excessively be small.

If the ink-spotted location is deviated from the predetermined location, color mixing among red, green and blue picture elements may be caused, and display quality of the produced organic EL display panel may be deteriorated.

Additionally, tangible specifications for variations in the discharge speeds cannot uniformly be determined. However, it would be required that variations in the discharge speed are reduced as much as possible, in order to achieve high-precision coating.

When the results obtained in Example 2, Comparative Example 2, and Comparative Example 3 are considered in view of the above criteria, the volume of the liquid droplet discharged from the inkjet head of Comparative Example 3 is 1.6 pL, i.e., larger than 1 pL, and therefore, it would be difficult to coat luminescent layer inks onto picture elements in organic EL display panels, with required precision.

Furthermore, the volume of the droplet discharged from the inkjet head in Comparative Example 2 is 1 pL, which may fulfill typical specifications. However, the inkjet head in Comparative Example 2 exhibits larger variations in the discharge speed, compared with the inkjet head of Example 2, and therefore, it is not considered that the structure of the inkjet head of Comparative Example 2 is optimum.

Second Embodiment

Figure 14:
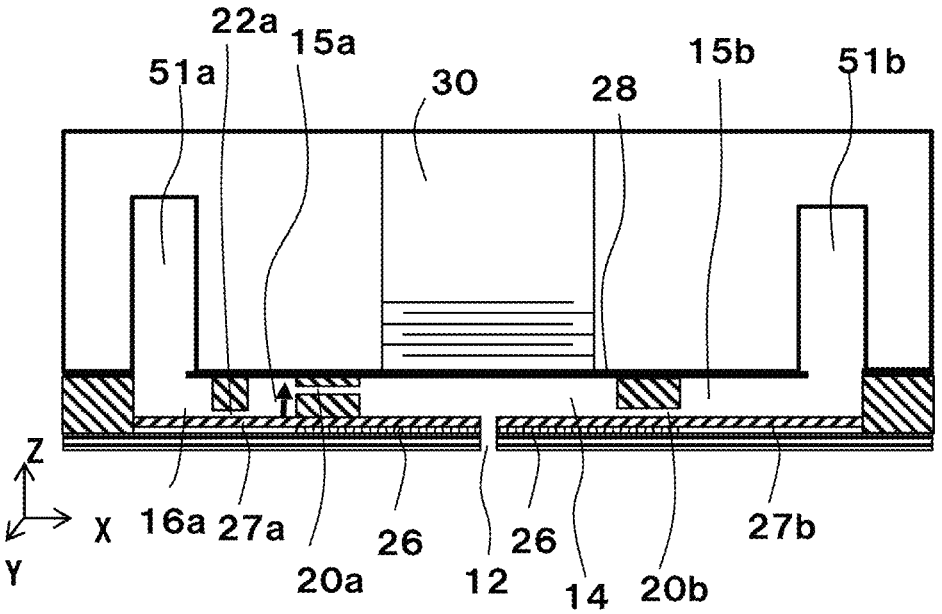
FIG. 14 is a cross-section of an inkjet head according to a second embodiment.

FIG. 14 is a cross-section view of that schematically shows a structure of an inkjet head according to the second embodiment.

Differences between the second embodiment and the first embodiment will mainly be described below.

Matters not mentioned in this embodiment are the same as the first embodiment.

(ii) With regard to a positional relationship between a supply-side first throttle part 20*a* and a supply-side second throttle part 22*a* in the Z-axis direction, the supply-side first throttle part 20*a* is farther away from a nozzle 12 than the supply-side second throttle part 22*a*.

By way of adopting such a positional relationship, an ink will move upward in a direction away from the nozzle 12 in the Z-axis direction within the supply-side second pressure chamber 15*a*, during the process of ink flow.

Accordingly, during the process of ink flow, coarse particles in the ink will settle out, and thus, will be accumulated inside the supply-side second pressure chamber 15*a*.

That is, it becomes possible to suppress penetration of the coarse particles into the first pressure chamber 14, so as to realize normal ink discharge.

(ii) In a throttle structure at the ink-discharge side, only a discharge-side first throttle part 20*b* is provided.

This is because the sedimented particles within the first pressure chamber 14 are discharged as much as possible.

(iii) The discharge-side first throttle part 20*b*, which is located at the ink-discharge side, is provided at a location close to in the Z-axis direction.

Accordingly, it becomes possible to easily discharge the coarse particles settled out within the first pressure chamber 14.

(iv) Rigidness of a supply-side damper 27*a* is higher than rigidness of a discharge-side damper 27*b*.

Specifically, a width of the discharge-side damper 27*b* in the X-axis direction is larger than that of the supply-side damper 27*a*.

In that case, the width of the damper refers to a width of a part that is not fixed by any supports, i.e., a width of a part that alleviate the oscillation.

In other words, the width refers to a width of a part that is not supported by a rigid plate 26.

By varying materials of the supply-side damper 27*a* and the discharge-side damper 27*b*, degrees of rigidness of these members may be varied.

(v) The supply-side damper 27*a* or the discharge-side damper 27*b* preferably have a resonance frequency higher than that of a diaphragm non-fixed part 28.

The supply-side damper 27*a* or the discharge-side damper 27*b* more effectively alleviates oscillation of inks compared with the diaphragm non-fixed part 28.

Details will be described with reference to Table 2.

The diaphragm non-fixed part 28 refers to a part of diaphragm that fluctuates.

TABLE 2

| | Density (kg/m$^3$) | Young's modulus (GPa) | Thickness (μm) | Width (μm) | Sectional secondary moment | Resonance frequency (Hz) |
|---|---|---|---|---|---|---|
| Diaphragm non-stationary part 28 | 8900 | 209 | 4.0 | 50 | $2.67 \times 10^{-22}$ | $2.5 \times 10^{-4}$ |
| Supply-side damper 27a or Discharge-side damper 27b | 7930 | 193 | 20.0 | 1000 | $6.67 \times 10^{-19}$ | $3.2 \times 10^{-4}$ |

A material for the diaphragm non-fixed part 28 may be a nickel alloy, a density thereof may be about 8900 kg/m$^3$, and the Young's modulus may be about 209 GPa.

With regard to dimensions of the diaphragm non-stationary part 28 within the inkjet head 10, the thickness in the Z-axis direction may be about 4 μm, and the width in the X-axis direction may be about 50 μm.

When, based on these values, a sectional secondary moment of the diaphragm non-stationary part 28 is calculated, a value of $2.67\times10^{-22}$ is obtained therefor, and thus, a resonance frequency is calculated as $2.5\times10^{-4}$ Hz.

On the other hand, a material for the supply-side damper 27*a* or the discharge-side damper 27*b* may be a stainless steel, and the density thereof may be about 7930 kg/m$^3$, the Young's modulus may be about 193 GPa, the thickness may be about 20 μm, and the width may be about 1000 μm.

Then, a sectional secondary moment of the supply-side damper 27*a* or the discharge-side damper 27*b* is calculated as $6.67\times10^{-19}$, and the resonance frequency thereof is calculated as $3.2\times10^{-4}$ Hz.

Thus, it is realized that the resonance frequency of the supply-side damper 27*a* or the discharge-side damper 27*b* is larger than the resonance frequency of the diaphragm non-stationary part 28.

<Cases in which Inks Contain Particles>

Cases using inks in particles are dispersed will be described.

Physical properties may be adjusted with dispersing agents or based on adjustment of the pH of the solution, such that particles can stably exist therein.

However, there may be cases in which particles are aggregated to produce coarse particles in the inks, in contradiction to intended designs of inks.

If such particles that disagree with the design flow into the nozzle 12, the nozzle may be clogged, and thus, discharge of liquid droplets may be impossible.

Meanwhile, particles in inks will settle out over time.

With regard to sedimentation of particles, a sedimentation rate is determined by the Stokes' law, which is expressed by Formula 2.

$$v_s = \frac{D_p^2(\rho_p - \rho_f)g}{18\eta} \quad \text{(Formula 2)}$$

Figure 15:
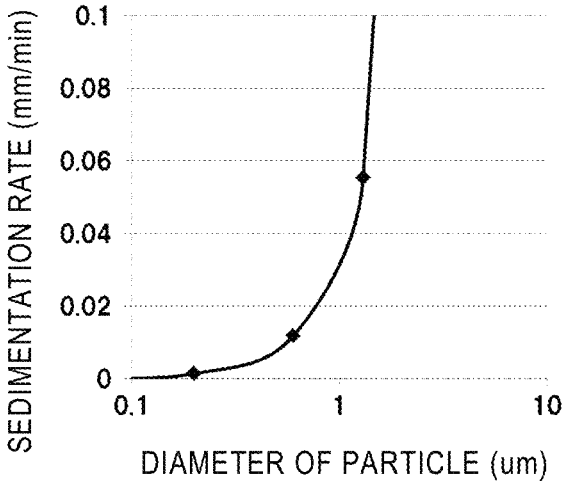
FIG. 15 is a diagram that shows relations between particle sizes and sedimentation rates in the second embodiment.

$v_s$: Sedimentation rate
$D_p$: Diameter of particle
$\rho_p$: Density of particle
$\rho_f$: Density of liquid
$\eta$: Viscosity of ink
g: Gravitational acceleration FIG. 15 shows the sedimentation rate versus the diameter of particles that are dispersed in an ink in a case where the viscosity of ink is 3 mPa·s, the density of particles is 4 g/cm$^3$, and the density of liquid is 1 g/cm$^3$.

It would be realized that, when particles with a diameter of 1.3 μm are dispersed in an ink, the particles settle out in the liquid at a sedimentation rate of 0.055 mm/minute.

A height of the supply-side second pressure chamber 15*a* in the Z-axis direction may be about 0.2 mm, and therefore, it would be realized that the particles settle out in about four minutes.

By causing coarse particles to settle out in the supply-side second pressure chamber 15*a* in the above way, penetration of the coarse particles into the nozzle 12 can be suppressed.

Within the discharge-side second pressure chamber 15*b*, the discharge-side first throttle part 20*b* is provided downward in the Z-axis direction so that the particles that have been settled out do not accumulate in the discharge-side second pressure chamber 15*b*.

By adopting such a head structure, inks can stably be discharged without causing any clogging of nozzles even when particles are dispersed in the inks.

(As a Whole)

Parts of the first and second embodiments can be combined with each other.

In particular, any of features mentioned in subsections (i)-(v) in the second embodiment can be combined with the first embodiment.

In other words, at least one of the features of (i)-(v) can be adopted in the inkjet head according to the first embodiment.

Figure 16:
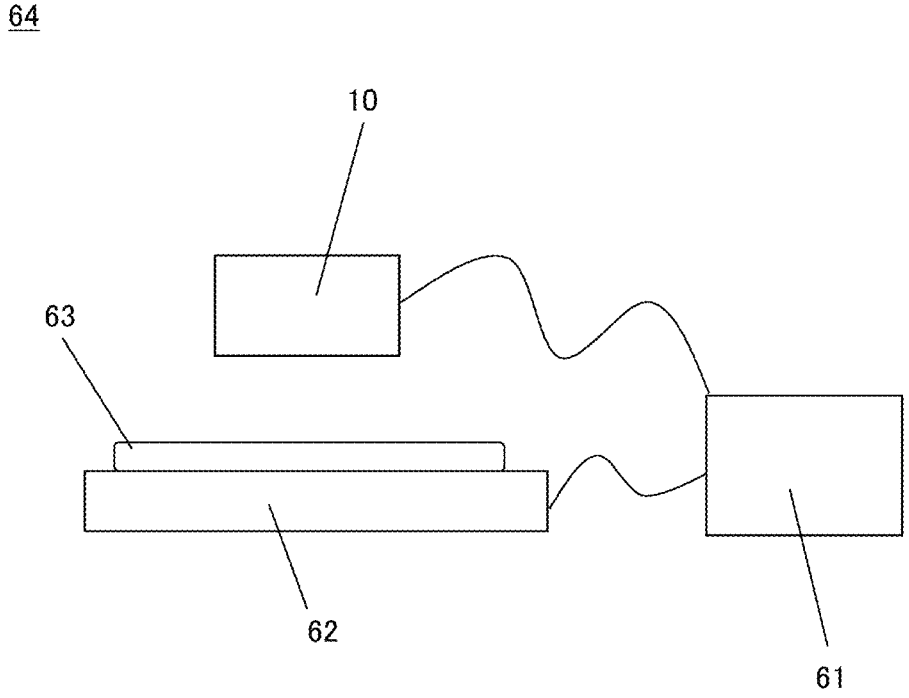
FIG. 16 is a lateral view of an inkjet device according to an embodiment.

FIG. 16 is a lateral view of an inkjet device 64 including an inkjet head 10 according to the disclosure.

The inkjet device 64 includes: the inkjet head 10 that discharges an ink; a drive-controlling unit 61 that produces drive voltage signals applied to the actuator 30 and that controls discharge operations of the inkjet head 10; and a conveying unit 62 that causes relative movements of the inkjet head 10 and a subject 63 to be lithographed.

Every type of device can be manufactured by way of coating inks onto the subject 63, which will serve as every type of device.

Inkjet heads, and inkjet devices according to the disclosure can be employed for the purposes of production of organic EL display panels that require high-precision picture elements, and the like. More specifically, the inkjet heads and inkjet devices can be employed for the purposes of coating processes for forming luminous layers in organic EL display panels, coating of decoration inks or resin seal inks using ultraviolet curable inks, coating of electrically conductive inks, coating of aqueous inks for decoration applications, etc.

What is claimed is:

1. An inkjet head, comprising:

(i) multiple discharge units, each including
- a nozzle that discharge a liquid droplet,
- a first pressure chamber that is connected to the nozzle,
- a supply-side second pressure chamber and a discharge-side pressure chamber that are connected to the first pressure chamber,
- a supply-side third pressure chamber that is connected to the supply-side second pressure chamber,
- a discharge-side third pressure chamber that is connected to the discharge-side second pressure chamber,
- an energy-generating element that imparts a discharge force to a liquid inside the first pressure chamber,
- a supply-side first throttle part that is provided between the first pressure chamber and the supply-side second pressure chamber,
- a discharge-side first throttle part that is provided between the first pressure chamber and the discharge-side second pressure chamber,
- a supply-side second throttle part that is provided between the supply-side second pressure chamber and the supply-side third pressure chamber, and
- a discharge-side second throttle part that is provided between the discharge-side second pressure chamber and the discharge-side third pressure chamber;

(ii) a supply-side common flow channel that connects the supply-side third pressure chambers in the respective multiple discharge units; and (iii) a discharge-side common flow channel that connects the discharge-side third pressure chambers in the respective multiple discharge units.

2. The inkjet head according to claim 1, wherein the first pressure chamber, the supply-side second pressure chamber, the discharge-side second pressure chamber, the supply-side third pressure chamber, and the discharge-side third pressure chamber are linearly arranged.

3. The inkjet head according to claim 1, wherein a line joining the supply-side first throttle part and the supply-side second throttle part is not parallel to an ink-flow direction.

4. The inkjet head according to claim 1, further comprising a supply-side damper provided in the supply-side second pressure chamber.

5. The inkjet head according to claim 4, wherein the supply-side damper is provided so as to extend over the supply-side third pressure chamber and the supply-side second pressure chamber.

6. The inkjet head according to claim 4, wherein a part of the supply-side damper is located in midair.

7. The inkjet head according to claim 4, wherein the supply-side first throttle part is farther away from the supply-side damper than the supply-side second throttle part.

8. The inkjet head according to claim 1, wherein the supply-side second throttle part has a channel resistance greater than the supply-side first throttle part.

9. An inkjet head, comprising:

(i) multiple discharge units, each including
- a nozzle that discharges a liquid droplet,
- a first pressure chamber that is connected to the nozzle,
- a supply-side second pressure chamber and a discharge-side pressure chamber that are connected to the first pressure chamber,
- a supply-side third pressure chamber that is connected to the supply-side second pressure chamber,
- an energy-generating element that imparts a discharge force to a liquid inside the first pressure chamber,
- a supply-side first throttle part that is provided between the first pressure chamber and the supply-side second pressure chamber,
- a discharge-side first throttle part that is provided between the first pressure chamber and the discharge-side second pressure chamber, and
- a supply-side second throttle part that is provided between the supply-side second pressure chamber and the supply-side third pressure chamber;

(ii) a supply-side common flow channel that connects the supply-side third pressure chambers in the respective multiple discharge units; and (iii) a discharge-side common flow channel that connects the discharge-side second pressure chambers in the respective multiple discharge units.

10. The inkjet head according to claim 9, wherein the first pressure chamber, the supply-side second pressure chamber, the discharge-side second pressure chamber, and the supply-side third pressure chamber are linearly arranged.

11. The inkjet head according to claim 9, wherein a line joining the supply-side first throttle part and the supply-side second throttle part is not parallel to an ink-flow direction.

12. The inkjet head according to claim 9, further comprising a supply-side damper that is provided in the supply-side second pressure chamber, and a discharge-side damper that is provided in the discharge-side second pressure chamber, wherein the supply-side damper has rigidness higher than the discharge-side damper.

13. An inkjet device, comprising:

the inkjet head according to claim 1;

a drive control unit that produces a drive voltage signal applied to the energy-generating element and that controls a discharge action of the inkjet head; and a conveying unit that causes a relative movement of the inkjet head and a subject to be lithographed.

* * * * *